US009491807B2

(12) United States Patent
Schilling et al.

(10) Patent No.: US 9,491,807 B2
(45) Date of Patent: Nov. 8, 2016

(54) METHOD FOR INDUCTION HEATING AND INDUCTION HEATING DEVICE

(71) Applicant: E.G.O. Elektro-Gerätebau GmbH, Oberderdingen (DE)

(72) Inventors: Wilfried Schilling, Kraichtal (DE); Christian Egenter, Bretten (DE); Werner Kappes, Neckargerach (DE); Stefan Westrich, Bretten (DE)

(73) Assignee: E.G.O. ELEKTRO-GERÄTEBAU GMBH, Oberderdingen (DE)

( * ) Notice: Subject to any disclaimer, the term of this patent is extended or adjusted under 35 U.S.C. 154(b) by 1064 days.

(21) Appl. No.: 13/627,799

(22) Filed: Sep. 26, 2012

(65) Prior Publication Data

US 2013/0078346 A1 Mar. 28, 2013

(30) Foreign Application Priority Data

Sep. 26, 2011 (DE) ..... 10 2011 083 397

(51) Int. Cl.
*H05B 6/08* (2006.01)
*H05B 6/12* (2006.01)
(Continued)

(52) U.S. Cl.
CPC ..... *H05B 6/062* (2013.01); *H05B 2213/07* (2013.01)

(58) Field of Classification Search
CPC ..... H05B 6/04; H05B 6/06; H05B 6/062; H05B 6/065; H05B 2213/07
USPC ..... 219/620, 621, 626, 627, 660, 661, 667, 219/675
See application file for complete search history.

(56) References Cited

U.S. PATENT DOCUMENTS 3,786,219 A * 1/1974 Kornrumpf ..... G05D 23/24 219/626
5,545,880 A 8/1996 Bu et al.
(Continued)

FOREIGN PATENT DOCUMENTS

CN 1116290 2/1996
DE 102 53 198 6/2004
(Continued)

OTHER PUBLICATIONS

German patent application No. DE 10 2011 083 383.8 filed Sep. 26, 2011.
(Continued)

*Primary Examiner* — Hung D Nguyen
(74) *Attorney, Agent, or Firm* — Lee & Hayes, PLLC

(57) ABSTRACT

A method and apparatus for preparing foodstuffs cooked in a liquid in a cooking vessel is provided. According to various aspects, an induction heating device includes a resonant circuit with an induction heating coil. A parameter value of the resonant circuit may be determined, depending on a temperature of a bottom of the vessel. During a heating-up phase, a high-frequency rectangular voltage may be applied to the resonant circuit to supply heating power to the bottom of the vessel. A heating power setpoint may be periodically varied and may be set to a first value during a first interval of a period, and set to a second, smaller value during a remaining interval. A determination of a change in the parameter value within the period may be made, and an evaluation of the change in order to determine the boiling point of the liquid and end the heating-up phase.

8 Claims, 1 Drawing Sheet

(51) Int. Cl.
*H05B 6/04* (2006.01)
*H05B 6/06* (2006.01)

(56) References Cited

U.S. PATENT DOCUMENTS

| | | | | |
|---|---|---|---|---|
| 6,904,378 | B2 | 6/2005 | Schilling et al. | |
| 6,995,343 | B2 | 2/2006 | Steiner et al. | |
| 2004/0054486 | A1 * | 3/2004 | Schilling | G05D 23/20 99/331 |
| 2009/0173731 | A1 | 7/2009 | Nagamitsu et al. | |
| 2011/0089156 | A1 | 4/2011 | Santacatterina et al. | |
| 2011/0120989 | A1 | 5/2011 | Schilling et al. | |

FOREIGN PATENT DOCUMENTS

| | | |
|---|---|---|
| DE | 10 2004 033 115 A1 | 9/2006 |
| JP | 2009-105079 | 5/2009 |
| JP | 2009289594 | 10/2009 |
| JP | 2011171206 | 1/2011 |

OTHER PUBLICATIONS

German patent application No. DE 10 2011 083 386.2 filed Sep. 26, 2011.

German Office Action dated May 29, 2012 in DE 10 2011 083 397.8.

German Office Action dated May 29, 2012 in DE 10 2011 083 383.8.

German Office Action dated May 29, 2012 in DE 10 2011 083 386.2.

European Search Report dated Jun. 17, 2013 in German patent application 12185400.4 (corresponds to U.S. Appl. No. 13/627,799).

European Search Report dated Jun. 14, 2013 in German patent application 12185392.3 (corresponds to U.S. Appl. No. 13/627,807).

European Search Report dated Jun. 14, 2013 in German patent application 12185387.3 (corresponds to U.S. Appl. No. 13/627,803).

Chinese Office Action from Application No. CN 201210459974.7 dated Apr. 21, 2015; 8 pages.

U.S. Appl. No. 13/627,803, filed Sep. 26, 2012, entitled "Method for Heating a Liquid in a Cooking Vessel and Induction Heating Device", First named inventor: Schilling.

U.S. Appl. No. 13/627,807, filed Sep. 26, 2012, entitled "Method for Heating a Cooking Vessel with an Induction Heating Device and Induction Heating Device", First named inventor: Schilling.

JP Office Action from Application No. 2012-211694 dated May 26, 2016; 3 pages.

* cited by examiner

METHOD FOR INDUCTION HEATING AND INDUCTION HEATING DEVICE

CROSS REFERENCE TO RELATED APPLICATIONS

This application claims the benefit of German patent application DE 10 2011 083 397.8, filed on Sep. 26, 2011, the contents of which are incorporated by reference for all that it teaches.

FIELD

The invention relates to a method for preparing foodstuffs with an induction heating device and to an induction heating device.

BACKGROUND

With induction heating devices, a magnetic alternating field, which induces eddy currents in a cooking vessel which is to be heated and which has a bottom made of ferromagnetic material, is produced by means of an induction heating coil and causes losses due to reversal of magnetization, as a result of which the cooking vessel is heated.

The induction heating coil is part of a resonant circuit which comprises the induction heating coil and one or more capacitors. The induction heating coil is normally designed as a flat, helically wound coil with associated ferrite cores and is arranged, for example, under a glass ceramic surface of an induction hob. In doing so, the induction heating coil in conjunction with the cookware to be heated forms an inductive and a resistive part of the resonant circuit.

To drive or excite the resonant circuit, a low-frequency mains alternating voltage with a mains frequency of 50 Hz or 60 Hz for example is first rectified and then converted by means of semiconductor switches into an excitation or drive signal of higher frequency. The excitation signal or drive voltage is usually a rectangular voltage with a frequency in a range from 20 kHz to 50 kHz. A circuit to generate the excitation signal is also referred to as a (frequency) converter.

Different methods have been disclosed for adjusting a heating power supply to the cooking vessel depending on a set heating power setpoint.

In a first method, a frequency of the excitation signal or of the rectangular voltage is varied depending on the heating power to be emitted or supplied or on the required power transfer. This method for adjusting the heating power emission makes use of the fact that a maximum heating power emission occurs when the resonant circuit is excited at its resonant frequency. The greater the difference between the frequency of the excitation signal and the resonant frequency of the resonant circuit, the smaller the heating power emitted.

However, if the induction heating device has a plurality of resonant circuits, for example when the induction heating device forms an induction hob with different induction cooking zones, and different heating powers are set for the resonant circuits, beat frequencies, which can lead to annoying noises, can be caused due to superimposition of the different frequencies of the excitation signals.

A method for adjusting the heating power which prevents annoying noises due to beat frequencies of this kind is a pulse width modulation of the excitation signal at constant excitation frequency, with which an effective value of a heating power is adjusted by varying the pulse width of the excitation signal. However, with an effective-value control of this kind by varying the pulse width at constant excitation frequency, high switch-on and switch-off currents occur in the semiconductor switches, as a result of which a wide-bandwidth and energy-rich interference spectrum is produced.

It is frequently desirable to determine a temperature of the bottom of a cooking vessel which is inductively heated in this way in order, for example, to be able to generate specific time-dependent heating profiles, to determine a boiling point and/or to enable automatic cooking functions.

DE 10 2009 047 185 A1, which corresponds to pending U.S. Patent Application No. 2011/0120989, discloses a method and an induction heating device with which temperature-dependent ferromagnetic characteristics of the bottom of the cooking vessel are measured with high resolution and evaluated in order to determine the temperature of the bottom of the cooking vessel.

The characteristic of the temperature of the bottom of the cooking vessel when bringing foodstuffs, for example rice, floating in water to the boil behaves differently from when bringing pure water to the boil. Because the bottom of the pan is not completely covered with water but to a great extent with the foodstuff, convection in water is impeded. This makes the detection of the boiling point considerably more difficult.

SUMMARY

The disclosure herein provides a method for preparing foodstuffs, which are cooked in a liquid contained in a cooking vessel, utilizing an induction heating device, and an induction heating device for carrying out the method. According to various aspects, a parameter value of a resonant circuit of the induction heating device may be determined. The resonant circuit may include an induction heating coil. The parameter value may include a period duration of a natural resonant oscillation of the resonant circuit, and may depend on a temperature of the bottom of the cooking vessel. A high-frequency rectangular voltage may be applied to the resonant circuit during a heating-up phase such that a heating power to the bottom of the cooking vessel includes a heating power setpoint that is periodically varied. A first value may be set within a first interval of a period of the heating power setpoint, and a second value smaller than the first value may be set within a remaining interval of the period of the heating power setpoint. A change in the parameter value within the period may be determined and evaluated to determine the boiling point of the liquid.

BRIEF DESCRIPTION OF THE DRAWINGS

The invention is described below with reference to the drawings, which show preferred embodiments of the invention. In the drawings.

DETAILED DESCRIPTION

Figure 1:
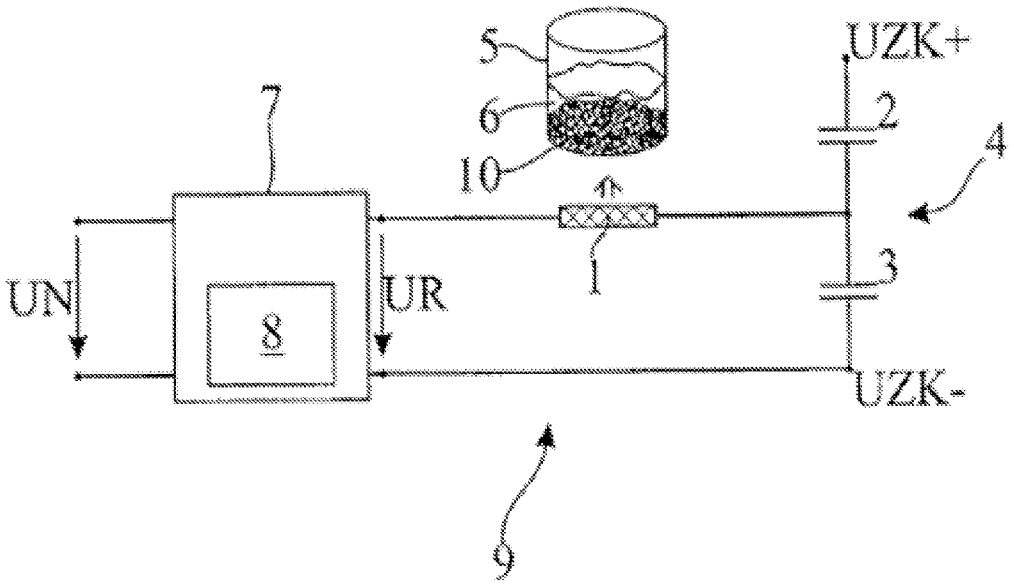
FIG. 1 shows schematically an induction heating device with a resonant circuit which has an induction heating coil and a control device.

The disclosure herein may be associate with the measuring principle disclosed in DE 10 2009 047 185 A1, which corresponds to pending U.S. Patent Application No. 2011/0120989, discussed above, but enable a reliable temperature-controlled or temperature-regulated cooking to be carried out, in particular by reliable determination of a boiling point. As will be described in detail below, various embodiments may be used to prepare foodstuffs, for example rice, which are cooked in a cooking vessel containing liquid, for example water, stock etc, utilizing an induction heating device which includes a resonant circuit with an induction heating coil. The embodiments may include continuous or periodic determination of a parameter value of the resonant circuit, in particular of a natural resonant frequency of the resonant circuit or of a period duration associated with the natural resonant frequency, the parameter value depending on a temperature of the cooking vessel, in particular of the bottom of the cooking vessel.

During a heating-up phase a high-frequency rectangular voltage may be applied to the resonant circuit in order to supply heating power having a heating power setpoint to the cooking vessel, in particular to the bottom of the cooking vessel. The heating power setpoint may be periodically varied. Within a period of the heating power set point variation the heating power setpoint may be set to a first value during a first interval of the period, for example approx. 48 seconds. During a remaining interval of the period of the heating power set point variation, i.e. period duration minus first interval, for example 12 seconds, the heating power setpoint may be set to a second, smaller value. The period of the heating power set point variation may have a duration of, for example, 60 seconds, wherein the duration can be constant or variable. A change in the parameter value may be determined within the period, in particular during the remaining interval within the period with the smaller setpoint, the determined change in the parameter value may be evaluated in order to determine the boiling point of the liquid and the heating-up phase may be terminated when the boiling point has been determined.

In an embodiment, when evaluating the determined change in the parameter value, a boiling point may be determined when the change in the parameter value is less than a specified amount. According to an embodiment, a simmering phase may be carried out on completion of the heating-up phase through the application of the high-frequency rectangular voltage to the resonant circuit with a heating power setpoint, which in particular corresponds to 5% to 50%, preferably 10% to 20%, of a maximum heating power setpoint. Monitoring may occur to determine whether the parameter value changes by more than a specified amount within a monitoring period, and the simmering phase may be ended when the parameter value changes by more than the specified amount within the monitoring period.

According to an embodiment, after determining the boiling point, in particular immediately after determining the boiling point, an instantaneous parameter value may be stored and a keep-warm phase carried out on completion of the simmering phase. During the keep-warm phase, the parameter value may be controlled to a parameter setpoint which is determined depending on the stored parameter value, for example by subtraction of a specified offset value.

In an embodiment, after determining the boiling point, in particular immediately after determining the boiling point, an instantaneous parameter value may be stored and a simmering phase carried out on completion of the heating-up phase. The simmering phase may include control of the parameter value to a parameter setpoint which is determined depending on the stored parameter value, monitoring of a heating power to be expended for control purposes and ending the simmering phase when the heating power to be expended is less than a specified amount. The simmering phase can be followed by a keep-warm phase.

Turning now to the drawings, FIG. 1 shows schematically an induction heating device 9 with a resonant circuit 4 which has an induction heating coil 1 and capacitors 2 and 3, and a power stage 7, which, controlled by a control device 8, conventionally rectifies a low-frequency mains alternating voltage UN with a mains frequency of, for example, 50 Hz, and subsequently, by means of semiconductor switches (not shown), converts it to a rectangular voltage UR with a frequency in a range from 20 kHz to 50 kHz, wherein the rectangular voltage UR is applied to the resonant circuit 4 or its induction heating coil 1 in order to supply heating power to a ferromagnetic bottom of a cooking vessel 5, wherein the cooking vessel contains water 6, into which rice 10 is placed in a ratio of 2:1.

The capacitors 2 and 3 are conventionally looped in series between poles UZK+ and UZK− of an intermediate circuit voltage, wherein a connecting node of the capacitors 2 and 3 is connected to a terminal of the induction heating coil 1.

The induction heating device 9 has measuring means which are not shown in more detail and which enable a continuous or periodic determination of a parameter value of the resonant circuit 4 in the form of a period duration Tp (see FIG. 2) of a natural-frequency resonant oscillation of the resonant circuit 4, wherein the period duration Tp is dependent on the temperature of the bottom of the cooking vessel, i.e. also increases with increasing temperature, as the effective inductance increases with increasing temperature of the bottom of the cooking vessel so that the resonant frequency decreases and accordingly the period duration increases. The period duration Tp can be determined for example by means of a timer of a microcontroller.

With regard to the design and basic function of the measuring means, the measuring method and the heating power adjustment, in order to avoid repetition, reference is also made to DE 10 2009 047 185 A1, which by such reference is herewith made content of the description.

Figure 2:
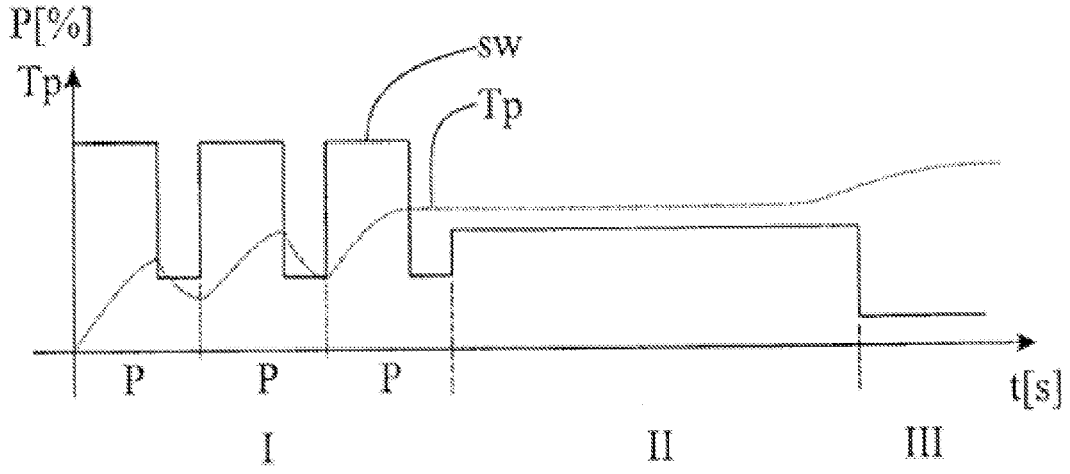
FIG. 2 shows schematically characteristics with respect to time of a heating power setpoint of the induction heating device shown in FIG. 1 and a period duration of a natural-frequency resonant oscillation of the resonant circuit.

FIG. 2 shows characteristics with respect to time of a heating power setpoint SW in 0.5% of a rated heating power of the induction heating device 9 shown in FIG. 1 and the period duration Tp of a natural-frequency resonant oscillation of the resonant circuit 4.

The control device 8 continuously or periodically determines the period duration Tp of a natural-frequency resonant oscillation of the resonant circuit 4, wherein the heating power supply is briefly interrupted and switched over to a natural-frequency resonant operation of the resonant circuit 4 for this purpose. These phases are not shown in FIG. 2 due to the low time resolution.

In a time interval I, which forms a heating-up phase or bring-to-the-boil phase, a high-frequency rectangular voltage UR is applied to the resonant circuit 4 in order to supply heating power to the bottom of the cooking vessel, wherein the associated heating power setpoint SW varies periodically. A first value, for example corresponding to 100% of the rated heating power, is set during a first interval, for example 48 seconds, within a particular period P, and a second, smaller value, for example corresponding to 10% of the rated heating power, is set during a remaining interval, for example 12 seconds.

Within the period P, the control device 8 determines a change in the period duration Tp, in particular while the smaller setpoint is set, and determines a boiling point when the change in the period duration Tp is less than a specified amount.

This is the case at the end of the bring-to-the-boil time interval I, wherein a simmering phase II is carried out on completion of the bring-to-the-boil time interval I. During the simmering phase II, the heating power setpoint is approx. 10% to 20% of a maximum heating power setpoint. The system monitors whether the period duration Tp changes by more than a specified amount during a monitoring period, for example 10 seconds, which can be caused, for example by the temperature of the bottom rising relatively quickly when the water 6 has been absorbed by the rice 10 or has evaporated.

The simmering phase II is then ended and is followed by a keep-warm phase III, during which the period duration Tp is controlled to a setpoint which is determined depending on a period duration Tp which is set immediately after determining the boiling point by subtracting a specified offset value from this value.

Instead of the described simmering and keep-warm phase II and III respectively, it is also possible to proceed as follows in order to simmer and keep warm. Immediately after determining the boiling point, a period duration Tp is stored as a setpoint. The period duration Tp is then controlled to this setpoint. The heating power to be expended for control purposes is monitored and if the heating power to be expended is less than a specified amount, the simmering phase is ended. The simmering phase can be followed by a keep-warm phase.

Rice 10 can be prepared using the so-called swelling method. To this end, a quantity of rice 10 is brought to the boil with a quantity of water 6, e.g. in a ratio of 1:2, and cooked until the water 6 has been completely absorbed by the rice 10 or has evaporated. In doing so, the simmering power is adjusted so that very little water evaporates. This process is very easy to automate with the cooking system 9 described above.

The process can be divided into 3 phases: heating up, cooking and detecting the completion of cooking. A cooking program which features the three phases requires the functions of bringing-to-the-boil with boiling point detection, simmering with temperature monitoring, and detection of the completion of cooking.

The characteristic of the temperature of the bottom when bringing rice or other foodstuffs floating in water to the boil is different from bringing pure water to the boil. Because the bottom of the pan is not completely covered with water but to a great extent with the foodstuff, convection in water is impeded.

In order to detect the boiling point, the heating power is reduced periodically, for example every minute, for 12 seconds for example, and the temperature characteristic or the characteristic of the representative period duration Tp is measured at the bottom of the pan. The amplitude of the temperature change due to the power variation reduces with increasing water temperature in order to assume a constant value after the boiling point is reached. This characteristic can be used to detect the boiling state.

After the boiling state has been detected, the power is reduced to simmering power, for example 10% to 20% of the rated power, and the temperature continuously monitored. When the water has been absorbed by the rice or has evaporated, the temperature of the bottom increases relatively quickly. This increase is detected and a finished signal can be given to a user.

At the same time, it is also possible to switch to keeping-warm mode at a controlled temperature below the boiling point. As the boiling point is known from the previous cooking process as a reference temperature or its equivalent in the form of the period duration Tp, the desired temperature can be set to a suitable keep-warm temperature, for example 80-90° C., with the help of a negative offset and controlled to this value.

It is understood that other/additional parameter values can also be used instead of the parameter value of the resonant circuit in the form of the period duration Tp, for example an amplitude of a resonant circuit voltage, a voltage across the induction heating coil, an amplitude of a resonant circuit current and/or a phase shift between the resonant circuit voltage and the resonant circuit current.

It is further understood that the disclosure herein can also be used in the context of a parallel resonant circuit or a series resonant circuit with full bridge control.

The invention claimed is:

1. A method for preparing foodstuffs, which are cooked in a liquid contained in a cooking vessel, utilizing an induction heating device, the method comprising:

continuously determining a parameter value of a resonant circuit of the induction heating device, the resonant circuit comprising an induction heating coil, wherein the parameter value comprises a period duration of a natural resonant oscillation of the resonant circuit, and wherein the parameter value depends on a temperature of a bottom of the cooking vessel;

applying a high-frequency rectangular voltage to the resonant circuit during a heating-up phase such that a heating power to the bottom of the cooking vessel comprises a heating power setpoint that is periodically varied, wherein within a first interval of a period of the heating power setpoint a first value is set, and a second value smaller than the first value is set within a remaining interval of the period of the heating power setpoint;

determining a change in the parameter value within the period;

evaluating the change in the parameter value to determine a boiling point of the liquid;

in response to determining the boiling point of the liquid, terminating the heating-up phase;

initiating a simmering phase after terminating the heating-up phase by applying the high-frequency rectangular voltage to the resonant circuit with the heating power setpoint corresponding to 5% to 50% of a maximum heating power setpoint, and monitoring whether the parameter value changes by more than a specified amount within a monitoring period; and terminating the simmering phase when the parameter value changes by more than the specified amount within the monitoring period.

2. The method of claim 1, wherein evaluating the change in the parameter value to determine the boiling point of the liquid comprises determining the boiling point when the change in the parameter value is less than a specified amount.

3. The method of claim 1, further comprising:

after determining the boiling point of the liquid, storing an instantaneous parameter value and upon termination of the simmering phase, initiating a keep-warm phase by controlling the parameter value to a parameter setpoint determined according to the instantaneous parameter value.

4. The method of claim 1, further comprising:

after determining the boiling point, storing an instantaneous parameter value;

initiating a simmering phase after terminating the heating-up phase by controlling the parameter value to a parameter setpoint determined according to the instantaneous parameter value, and monitoring a heating power to be expended for control purposes; and terminating the simmering phase when the heating power to be expended is less than the specified amount.

5. An induction heating device comprising:

a resonant circuit comprising an induction heating coil; and a control device configured to continuously determine a parameter value of the resonant circuit, the resonant circuit, wherein the parameter value comprises a period duration of a natural resonant oscillation of the resonant circuit, and wherein the parameter value depends on a temperature of a bottom of a cooking vessel;

apply a high-frequency rectangular voltage to the resonant circuit during a heating-up phase such that a heating power to the bottom of the cooking vessel comprises a heating power setpoint that is periodically varied, wherein within a first interval of a period of the heating power setpoint a first value is set, and a second value smaller than the first value is set within a remaining interval of the period of the heating power setpoint;

determine a change in the parameter value within the period;

evaluate the change in the parameter value to determine a boiling point of the liquid;

in response to determining the boiling point of the liquid, terminate the heating-up phase;

initiate a simmering phase after terminating the heating-up phase by applying the high-frequency rectangular voltage to the resonant circuit with the heating power setpoint corresponding to 5% to 50% of a maximum heating power setpoint, and monitoring whether the parameter value changes by more than a specified amount within a monitoring period; and terminate the simmering phase when the parameter value changes by more than the specified amount within the monitoring period.

6. The induction heating device of claim 5, wherein the control device being further configured to evaluate the change in the parameter value to determine the boiling point of the liquid being further configured to determine the boiling point when the change in the parameter value is less than a specified amount.

7. The induction heating device of claim 5, wherein the control device being further configured to after determining the boiling point of the liquid, store an instantaneous parameter value; and upon termination of the simmering phase, initiate a keep-warm phase by controlling the parameter value to a parameter setpoint determined according to the instantaneous parameter value.

8. The induction heating device of claim 5, wherein the control device being further configured to after determining the boiling point, store an instantaneous parameter value;

initiate a simmering phase after terminating the heating-up phase by controlling the parameter value to a parameter setpoint determined according to the instantaneous parameter value, and monitoring a heating power to be expended for control purposes; and terminate the simmering phase when the heating power to be expended is less than the specified amount.

* * * * *